US008193470B1

(12) United States Patent
Harlamert et al.

(10) Patent No.: US 8,193,470 B1
(45) Date of Patent: Jun. 5, 2012

(54) SELF-CLEANING CONVECTION OVEN

(75) Inventors: Michael E. Harlamert, Louisville, KY (US); Eric S. Elwell, Shepherdsville, KY (US); Brett J. Gregory, Hudson, KY (US); Lawrence R. Kaiser, Louisville, KY (US); Mark Halpin, Burlington, VT (US); Jiri Rabas, Lynnwood, WA (US)

(73) Assignee: KFC Corporation, Louisville, KY (US)

( * ) Notice: Subject to any disclaimer, the term of this patent is extended or adjusted under 35 U.S.C. 154(b) by 245 days.

(21) Appl. No.: 12/555,498

(22) Filed: Sep. 8, 2009

Related U.S. Application Data

(60) Provisional application No. 61/095,044, filed on Sep. 8, 2008.

(51) Int. Cl.

| | |
|---|---|
| ***F24C 14/00*** | (2006.01) |
| ***A21B 1/26*** | (2006.01) |
| ***A21B 3/04*** | (2006.01) |
| ***A21B 3/16*** | (2006.01) |

(52) U.S. Cl. ..... 219/401; 219/400; 126/20; 126/21 A

(58) Field of Classification Search ..... None
See application file for complete search history.

(56) References Cited

U.S. PATENT DOCUMENTS

| | | | | |
|---|---|---|---|---|
| 3,373,754 | A * | 3/1968 | Squire | 134/58 D |
| 5,499,577 | A * | 3/1996 | Tommasini | 99/476 |
| 6,410,890 | B1 * | 6/2002 | Kohlstrung | 219/401 |
| 6,435,078 | B1 * | 8/2002 | Batten et al. | 99/446 |
| 6,772,751 | B2 * | 8/2004 | Deuringer et al. | 126/20 |
| 6,987,246 | B2 | 1/2006 | Hansen et al. | |
| 7,157,668 | B2 | 1/2007 | Bartelick | |
| 7,282,674 | B2 | 10/2007 | Hansen et al. | |
| 7,307,244 | B2 | 12/2007 | Hansen et al. | |
| 7,317,173 | B2 | 1/2008 | Bartelick et al. | |
| 7,421,942 | B2 | 9/2008 | Hansen et al. | |
| 7,556,034 | B2 * | 7/2009 | De Miranda Grieco | 126/211 |
| 7,755,005 | B2 | 7/2010 | Bartelick et al. | |
| 2001/0032549 | A1 * | 10/2001 | Fukushima et al. | 99/476 |
| 2003/0145847 | A1 * | 8/2003 | Deuringer et al. | 126/377.1 |
| 2004/0261632 | A1 | 12/2004 | Hansen et al. | |

(Continued)

FOREIGN PATENT DOCUMENTS

DE 102007005502 A1 * 7/2008

OTHER PUBLICATIONS

DE-102007005502A1, Reimers et al, Jul. 2008, Machine translation of specification.*

*Primary Examiner* — Joseph M Pelham
(74) *Attorney, Agent, or Firm* — Stites & Harbison, PLLC; David W. Nagle, Jr.; Terry L. Wright

(57) ABSTRACT

A self-cleaning convection oven includes a cabinet defining an interior cavity for cooking a food product; a door moveable between an open position and a closed position for allowing access to the interior cavity; one or more heating elements positioned in the interior cavity for delivering heat to the interior cavity; a fan positioned within the interior cavity; and a plumbing system operably connected to a water supply for delivering water into the interior cavity of the oven through a first nozzle positioned near the fan. The plumbing system of the self-cleaning convection oven further also delivers a cleaning solution into the interior cavity of the oven.

18 Claims, 10 Drawing Sheets

U.S. PATENT DOCUMENTS

| | | | |
|---|---|---|---|
| 2005/0051038 | A1 | 3/2005 | Bartelick |
| 2005/0235980 | A1 | 10/2005 | Hansen et al. |
| 2006/0289441 | A1 | 12/2006 | Bartelick |
| 2007/0193295 | A1 | 8/2007 | Hansen et al. |
| 2007/0194003 | A1 | 8/2007 | Hansen et al. |
| 2007/0194004 | A1 | 8/2007 | Hansen et al. |
| 2008/0066629 | A1 | 3/2008 | Bartelick et al. |
| 2008/0078371 | A1* | 4/2008 | Boscaino ..... 126/20 |
| 2008/0223357 | A1* | 9/2008 | Bartelick et al. ..... 126/21 A |
| 2008/0264271 | A1 | 10/2008 | Hansen et al. |
| 2010/0229896 | A1 | 9/2010 | Bartelick |

* cited by examiner

SELF-CLEANING CONVECTION OVEN

CROSS-REFERENCE TO RELATED APPLICATIONS

This application claims priority to U.S. Provisional Patent Application No. 61/095,044 filed on Sep. 8, 2008, the entire disclosure of which is incorporated herein by reference.

BACKGROUND OF THE INVENTION

The present invention relates to convection ovens, and, more particularly, to a self-cleaning convection oven.

Convection ovens are commonly used in the restaurant industry for cooking a variety of food products. Of course, in the restaurant environment, it is important that there be an efficient way to clean food preparation equipment, including convection ovens. Conventional self-cleaning ovens generally employ a pyrolytic self-cleaning operation that relies on the incineration of all residue in the oven by heating the interior of the oven to approximately 1000° F. and maintaining the oven at that temperature for several hours. Then, after the oven cools down, any ash can be swept out of the oven. Although such a pyrolytic self-cleaning operation is common in ovens designed for home use, it is not used in commercial applications. Specifically, although several manufacturers have attempted to employ a pyrolytic self-cleaning operation in commercial ovens, none have proved successful. This is primarily because of certain technical challenges, such as (i) the impact of repeated thermal expansion and contraction cycles on the structural components resulting from executing the self-cleaning operation on a daily basis, and (ii) the difficulty in maintaining the temperature of the electronic and electromechanical components within their design limits when the interior of the oven is elevated to 1000° F. Because of such technical challenges, it would be desirable to develop a self-cleaning convection oven that does not rely on elevated heating and the incineration of all residue in the oven.

SUMMARY OF THE INVENTION

The present invention is a self-cleaning convection oven. Unlike prior art ovens that have a pyrolytic self-cleaning operation that relies on the incineration of all residue in the oven, the self-cleaning convection oven of the present invention relies on a chemical-based cleaning operation.

The oven is connected to a fresh water supply for delivering and introducing water into the interior cavity of the oven. In at least one exemplary embodiment, such water delivery is controlled by a pressure regulator, with water then being fed into a manifold. There is a water solenoid valve and a quench solenoid valve in the manifold. When the water solenoid valve is open, water is delivered to a first nozzle. This first nozzle is located in the interior cavity of the oven directly above the convection fan so that the water is discharged directly onto the convection fan for distribution throughout the interior cavity of the oven.

The self-cleaning convection oven also includes a means for delivering a cleaning solution into the interior cavity of the oven. The cleaning solution is supplied in a bottle (shown or a similar storage receptacle, which is connected to a peristaltic pump via a length of tubing. A recirculation pump is then used to deliver the cleaning solution to the interior cavity of the oven. In at least one exemplary embodiment, as the cleaning solution passes through the peristaltic pump, it is delivered through a length of tubing to a cross connector. The recirculation pump is used to pump water or effluent (i.e., water mixed with waste matter) from the interior cavity of the oven through a drain and to the recirculation pump when a drain valve is closed. The effluent then passes through the recirculation pump and is delivered to the cross connector. The cross connector thus mixes the chemical solution from the peristaltic pump with the effluent draining from the interior cavity of the oven and passing though the recirculation pump, with the mixture of cleaning solution and the effluent then being delivered to a recirculation solenoid valve. From the recirculation solenoid valve, the mixture of cleaning solution and the effluent is then delivered through a length of tubing to a second nozzle. The second nozzle is also located in the interior cavity of the oven directly above the convection fan so that the mixture of cleaning solution and the effluent is discharged directly onto the convection fan for distribution throughout the interior cavity of the oven.

In a representative self-cleaning cycle, there are multiple discrete phases in which varying combinations of water and the cleaning solution are held in or circulated throughout the interior cavity of the oven for various time periods, including, for example, a pre-rinse phase, a filling phase, a wash phase, a rinse phase, pump filling phase, a purging phase, a final rinse phase, and a flushing phase.

DETAILED DESCRIPTION OF THE INVENTION

The present invention is a self-cleaning convection oven.

Figure 1:
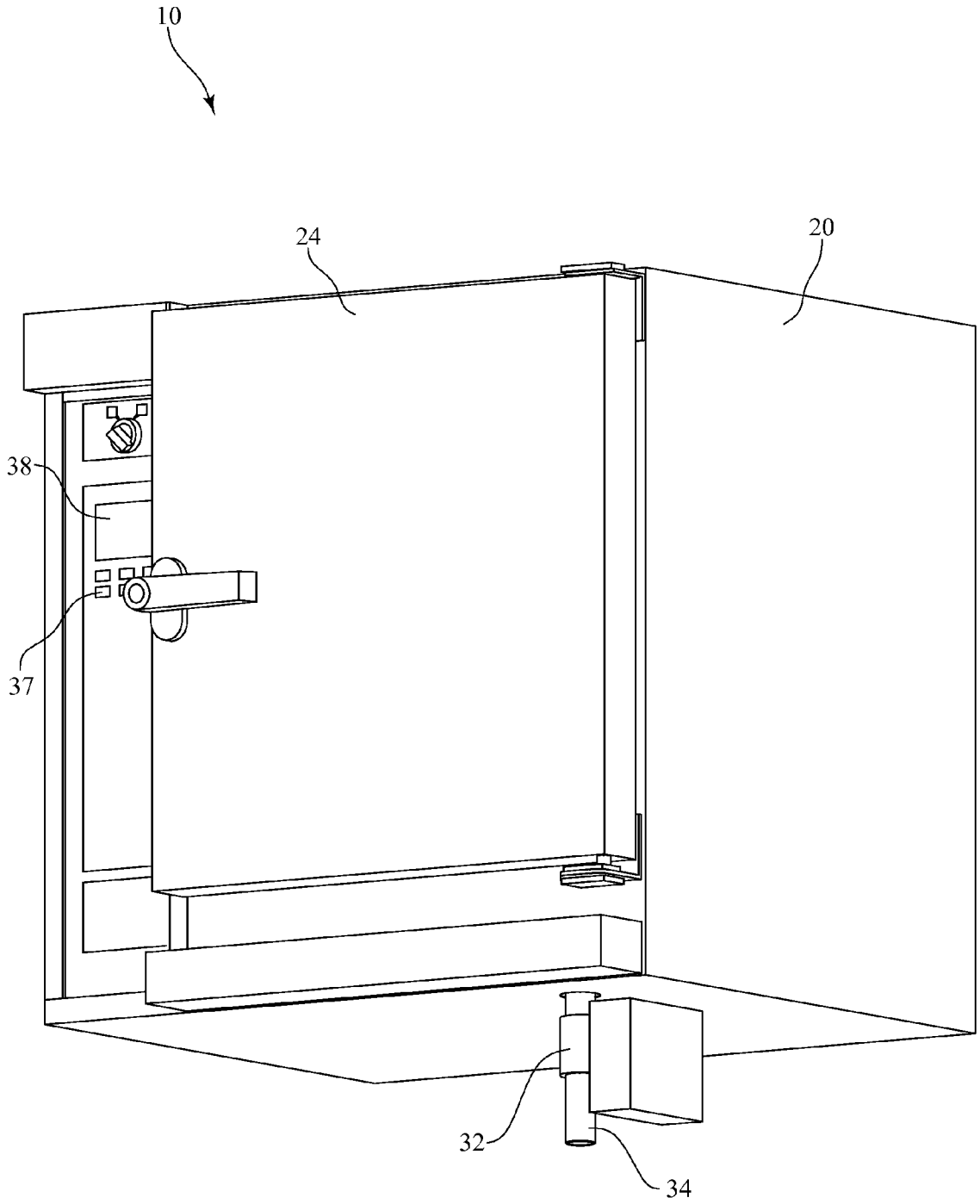
FIG. 1 is a perspective view of an exemplary self-cleaning convection oven made in accordance with the present invention.
Figure 2:
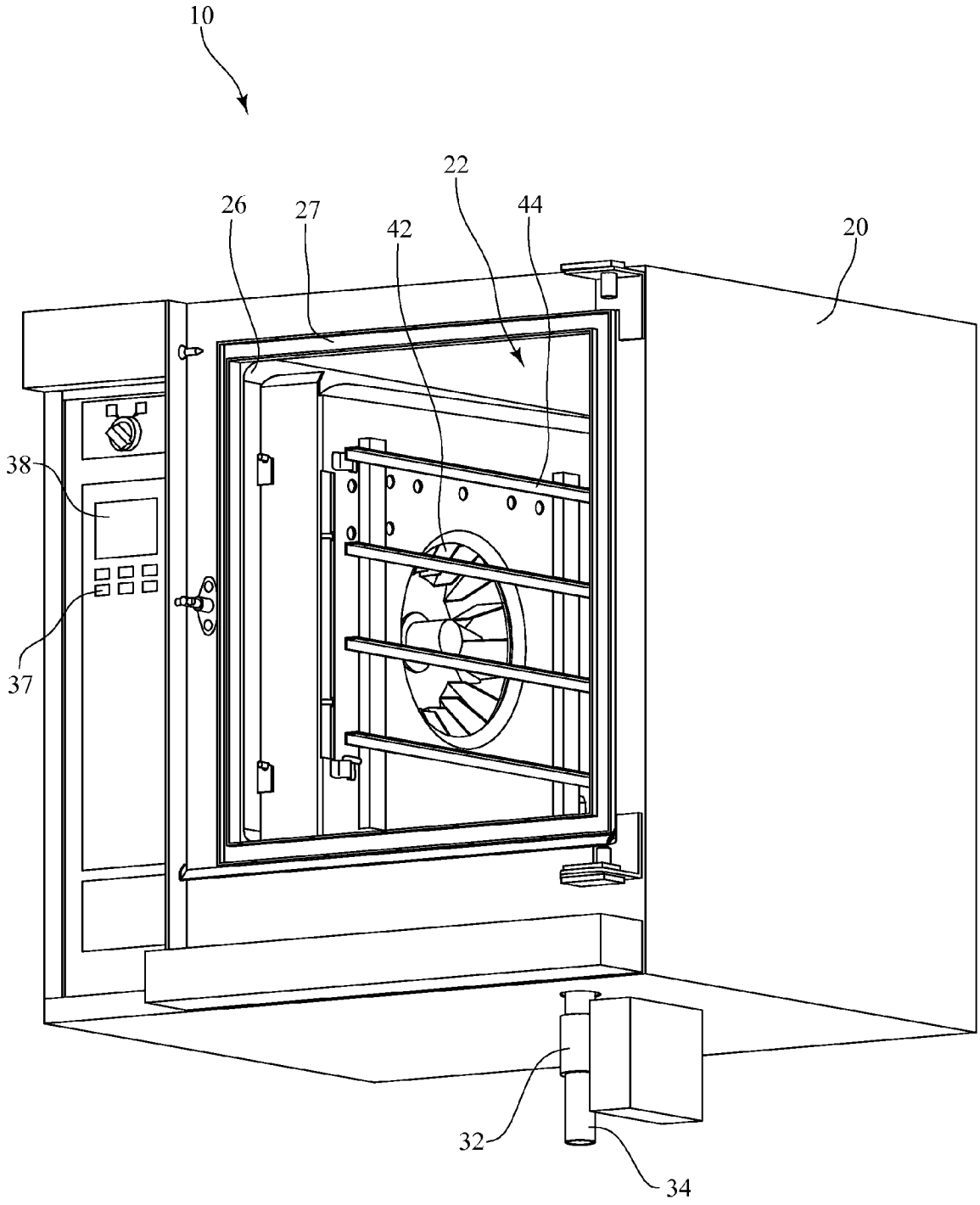
FIG. 2 is a perspective view of the exemplary self-cleaning convection oven of FIG. 1, but with the door removed to show the interior of the oven.
Figure 3:
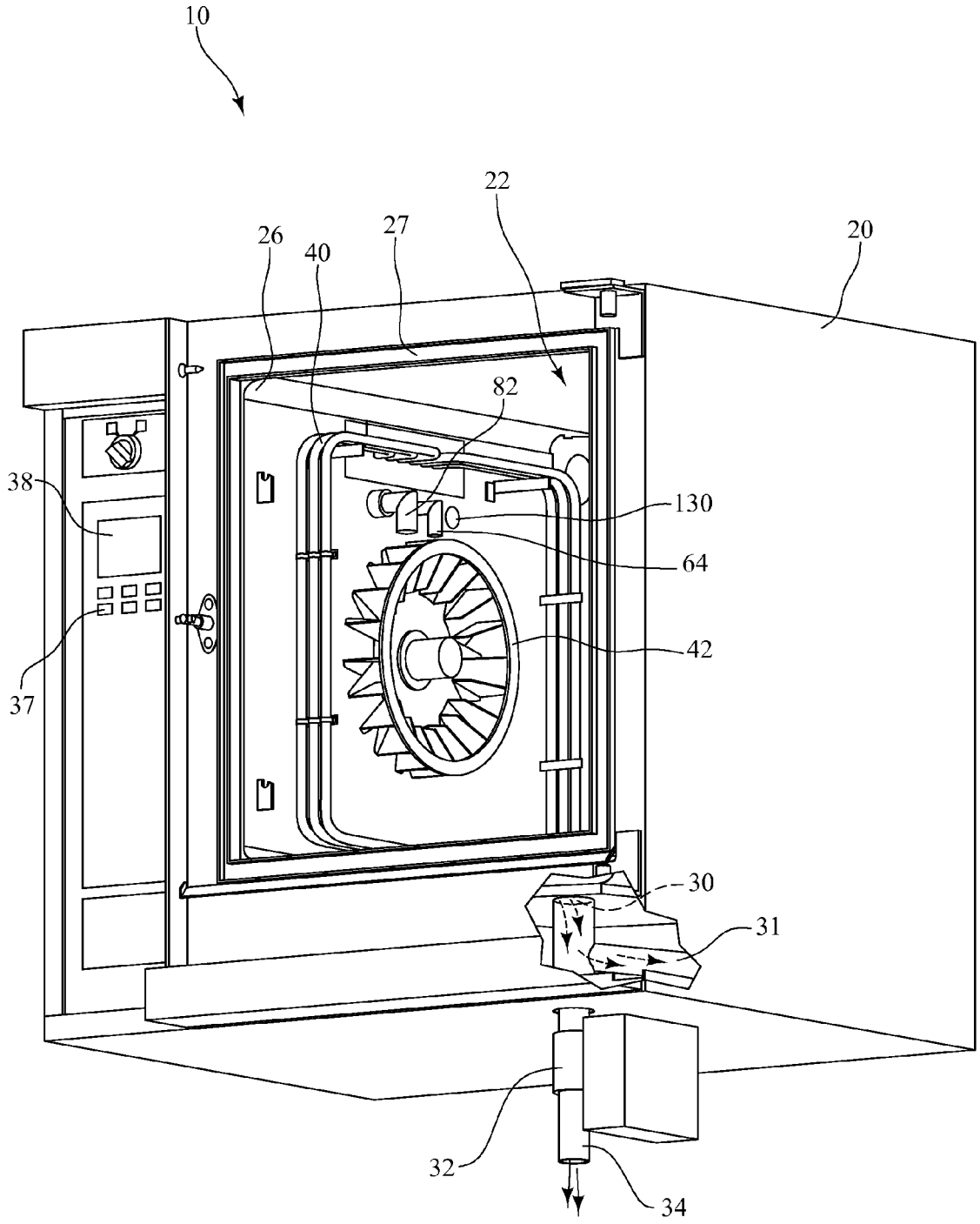
FIG. 3 is a perspective view of the exemplary self-cleaning convection oven similar to that of FIG. 2, but with certain panels removed or broken away to show the heating elements and other internal components of the oven.

Referring first to FIGS. 1-3, an exemplary self-cleaning convection oven 10 made in accordance with the present invention includes a generally rectangular cabinet 20 that defines an interior cavity 22 for cooking a food product. The oven 10 further includes a door 24 mounted on hinges and moveable between an open position and a closed position for allowing access to the interior cavity 22 of the oven 10. This door 24 has an appropriate gasket 27 to create a watertight seal when the door 24 is in the closed position. In the exemplary embodiment shown in FIGS. 1-3, the interior cavity 22 includes a welded stainless steel liner 26 (e.g., type 316 stainless steel) to eliminate the seams associated with conventional convection oven constructions that use individual wall, ceiling, and floor panels that are screwed or spot-welded together. The use of such a stainless steel liner 26 prevents grease migration into insulation (not shown) in the walls of the oven 10, but also is important for sealing the interior cavity 22 for the self-cleaning operation, as is further discussed below. In this exemplary embodiment, the floor of the oven 10 is in the form of a pan that is recessed below the bottom of the door 24 to collect any grease and to prevent it from flowing out when the door 24 is opened. A drain 30 is defined in the floor 28 to not only facilitate removal of collected grease, but also to facilitate the self-cleaning operation, as is further discussed below.

As with conventional convection oven constructions, there are one or more heating elements 40 positioned in the interior cavity 22 of the oven 10 which are operably connected to an appropriate control system for delivering heat to the interior cavity 22 of the oven 10. A convection fan 42 (or blower wheel) is positioned in the center of the heating elements 40 and circulates heated air to cook a food product. In this exemplary embodiment, the convection fan 42 has fewer blades than conventional constructions to prevent grease and debris from accumulating between the blades. Although not shown in FIGS. 1-3, the convection fan 42 would typically be comprised of a hub and a bladed portion secured to the hub. As such, the bladed portion could be readily removed from the hub for replacement. In any event, the convection fan 42 is driven by an appropriate motor and variable frequency drive (VFD), collectively indicated by reference numeral 43 in FIGS. 5 and 6.

Also, although not shown in FIGS. 1-3, with respect to the interior cavity 22 of the oven 10, it should be recognized that the oven 10 can include an oven vent designed to maintain the heat and smoke within the interior cavity 22 of the oven 10, only venting the interior cavity 22 when the pressure increases beyond a predetermined threshold.

Finally, in the exemplary embodiment shown in FIGS. 1-3, there are multiple guides 44 along the walls of the interior cavity 22 of the oven 10 that are adapted to receive and secure trays (not shown) of food product for cooking in the oven 10.

As mentioned above, the exemplary convection oven 10 is "self-cleaning" However, unlike prior art ovens that have a pyrolytic self-cleaning operation that relies on the incineration of all residue in the oven, the oven 10 relies on a chemical-based cleaning operation. As such, and referring now to the rear view of the exemplary self-cleaning convection oven 10 in FIG. 4, the left side view of FIG. 5, and the schematic diagram of the plumbing system in FIG. 6, the oven 10 is connected to a fresh water supply 58 for delivering and introducing water into the interior cavity 22 of the oven 10. Such water delivery is controlled by a pressure regulator 60, with water then being fed into a manifold 61. There is a water solenoid valve 62 and a quench solenoid valve 66 in the manifold 61. When the water solenoid valve 62 is open, water is delivered through a length of tubing 63 to a first nozzle 64. As best shown in FIG. 3, the first nozzle 64 is located in the interior cavity 22 of the oven 10 directly above the convection fan 42 so that the water is discharged directly onto the convection fan 42 for distribution throughout the interior cavity 22 of the oven 10. The function of the quench solenoid valve 66 is discussed below.

Figure 4:
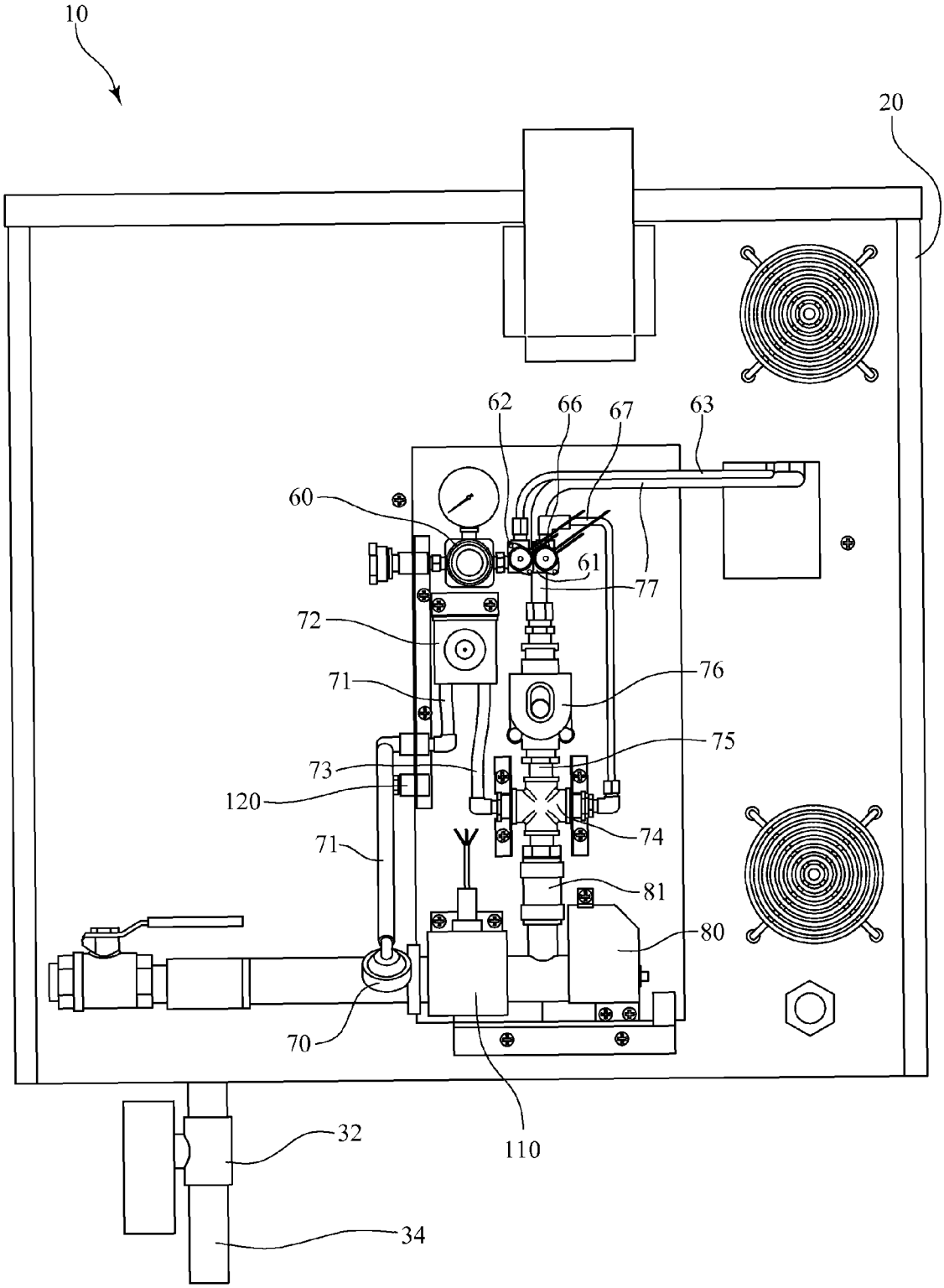
FIG. 4 is a rear view of the exemplary self-cleaning convection oven of FIG. 1, showing certain components of the plumbing system of the oven.

Referring again to FIGS. 4-6, the exemplary self-cleaning convection oven 10 also includes a means for delivering a cleaning solution into the interior cavity 22 of the oven 10. Specifically, in this exemplary embodiment, the cleaning solution is supplied in a bottle 68 (shown in the schematic diagram of FIG. 6) or a similar storage receptacle, which is connected to a pump (such as a peristaltic pump) 72 via a length of tubing 71. In this exemplary embodiment, and as best shown in FIG. 4, a cap 70 having a fitment equipped with a one-way valve can be operably connected to the end of the length of tubing 71 and then fastened to the open top of the bottle of cleaning solution. Thus, when the cap 70 is fastened to the open top of the bottle, the valve opens and allows the cleaning solution to flow when the peristaltic pump 72 is energized. However, when no bottle is fastened to the cap 70, the valve prevents any cleaning solution from leaking from the tubing 71.

Figure 5:
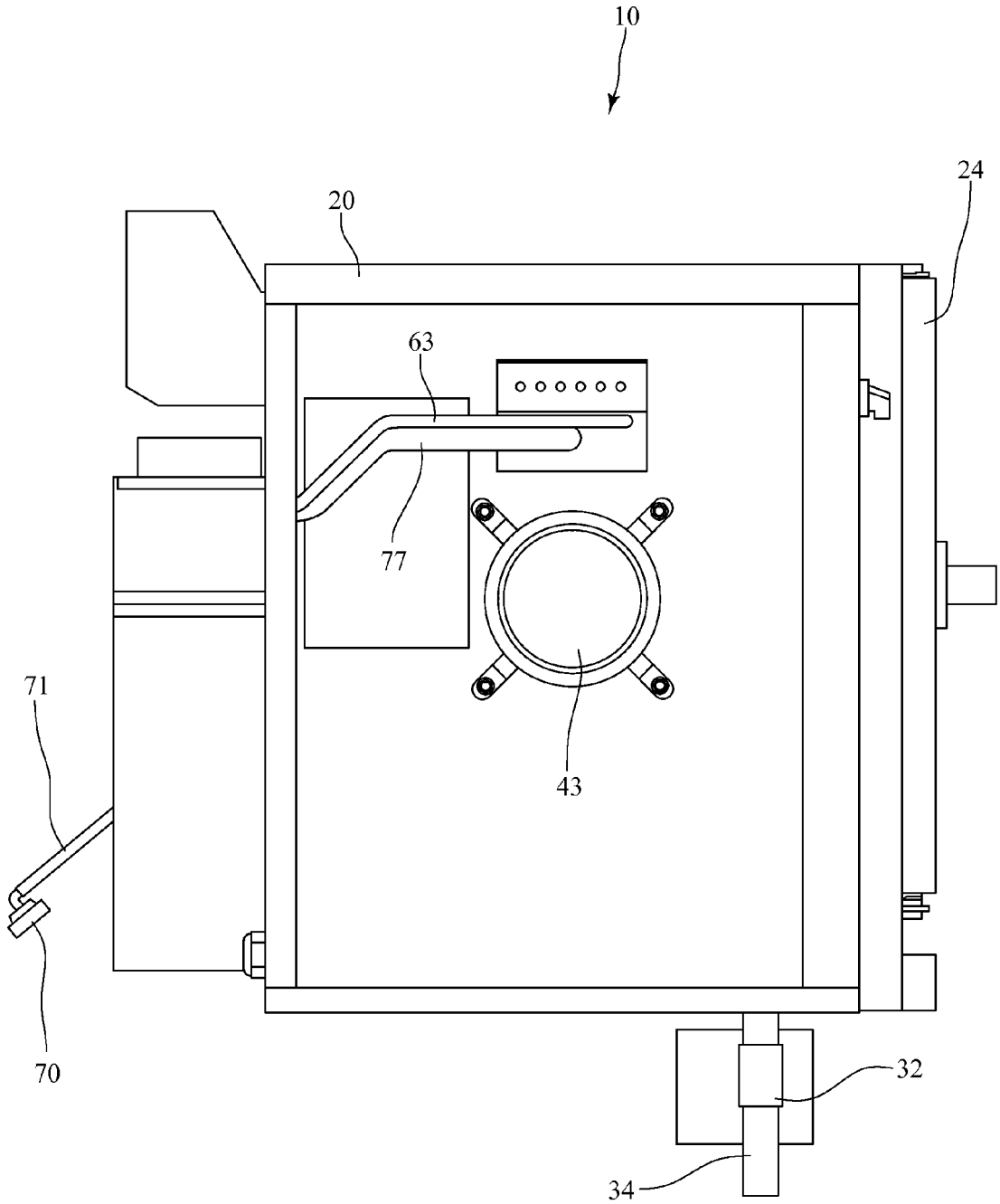
FIG. 5 is a left side view of the exemplary self-cleaning convection oven of FIG. 1, with the exterior wall panel removed to show the lines that direct water and cleaning solution from the plumbing system into the interior of the oven.
Figure 6:
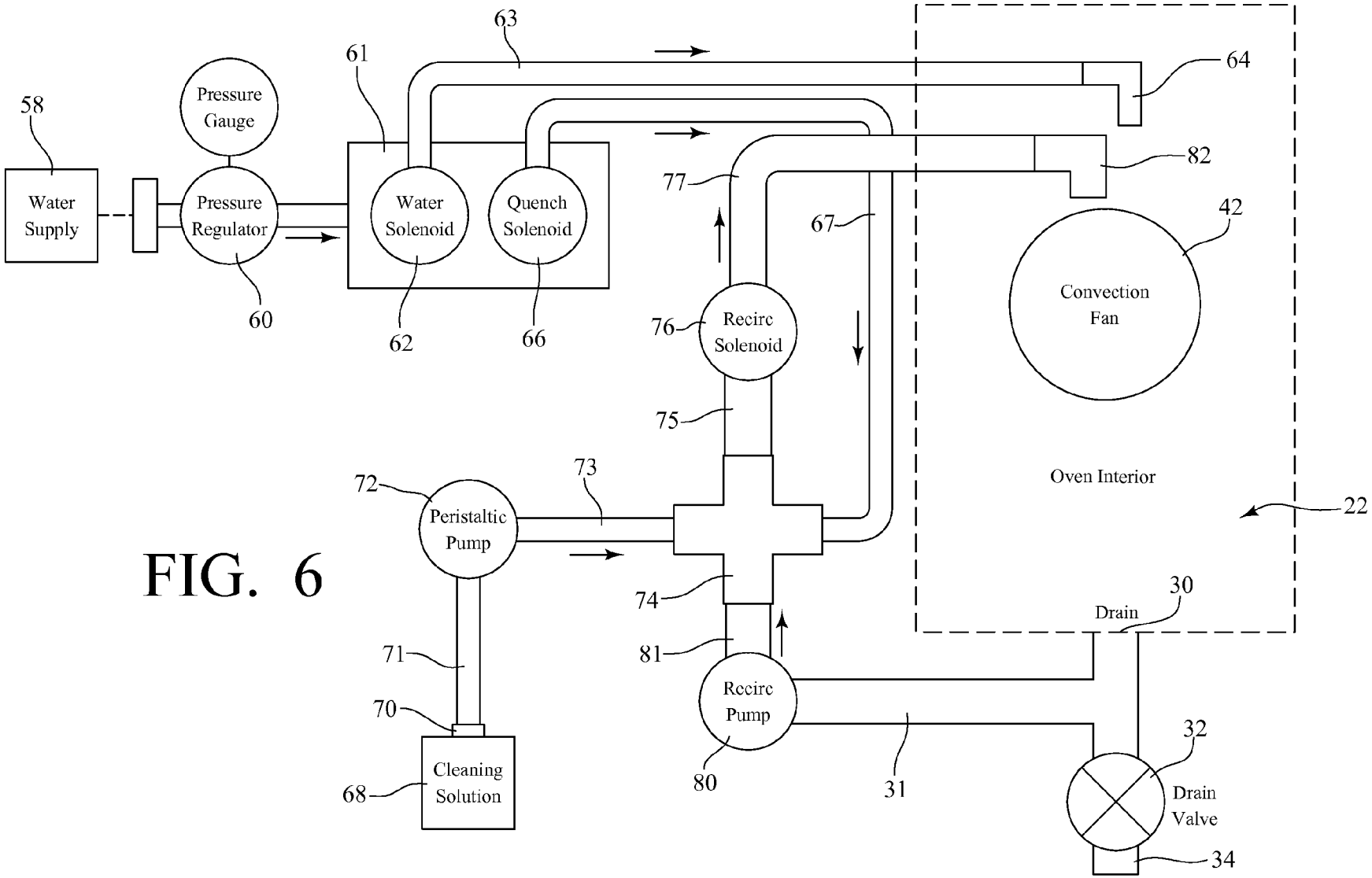
FIG. 6 is a schematic diagram of the plumbing system of the exemplary self-cleaning convection oven of FIGS. 1-5.

Referring still to FIGS. 4-6, a recirculation pump 80 is then used to deliver the cleaning solution to the interior cavity 22 of the oven 10. Specifically, as the cleaning solution passes through the peristaltic pump 72, it is delivered through a length of tubing 73 to a cross connector 74. The recirculation pump 80 is used to pump water or effluent (i.e., water mixed with waste matter) from the interior cavity 22 of the oven 10 through the drain 30 and through a conduit 31 to the recirculation pump 80 when a drain valve 32 is closed (as discussed below). The effluent then passes through the recirculation pump 80 and is delivered through a conduit 81 to the cross connector 74. The cross connector 74 thus mixes the chemical solution from the peristaltic pump 72 with the effluent draining from the interior cavity 22 of the oven 10 and passing though the recirculation pump 80, with the mixture of cleaning solution and the effluent then being delivered to a recirculation solenoid valve 76 by a conduit 75. From the recirculation solenoid valve 76, the mixture of cleaning solution and the effluent is then delivered through a length of tubing 77 to a second nozzle 82. As best shown in FIG. 3, the second nozzle 82 is also located in the interior cavity 22 of the oven 10 directly above the convection fan 42 so that the mixture of cleaning solution and the effluent is discharged directly onto the convection fan 42 for distribution throughout the interior cavity 22 of the oven 10.

As mentioned above, water from the water supply 58 is fed into the manifold 61. There is a water solenoid valve 62 and a quench solenoid valve 66 in the manifold 61. When the quench solenoid valve 66 is open, water is delivered through a length of tubing 67 into the above-described cross connector 74. By injecting a stream of cold water into the cross connector 74, the effluent is diluted and ensures that the temperature of the effluent does not exceed local plumbing codes when it is ultimately drained from the oven 10, as discussed further below with reference to FIGS. 8 and 9.

Figure 7:
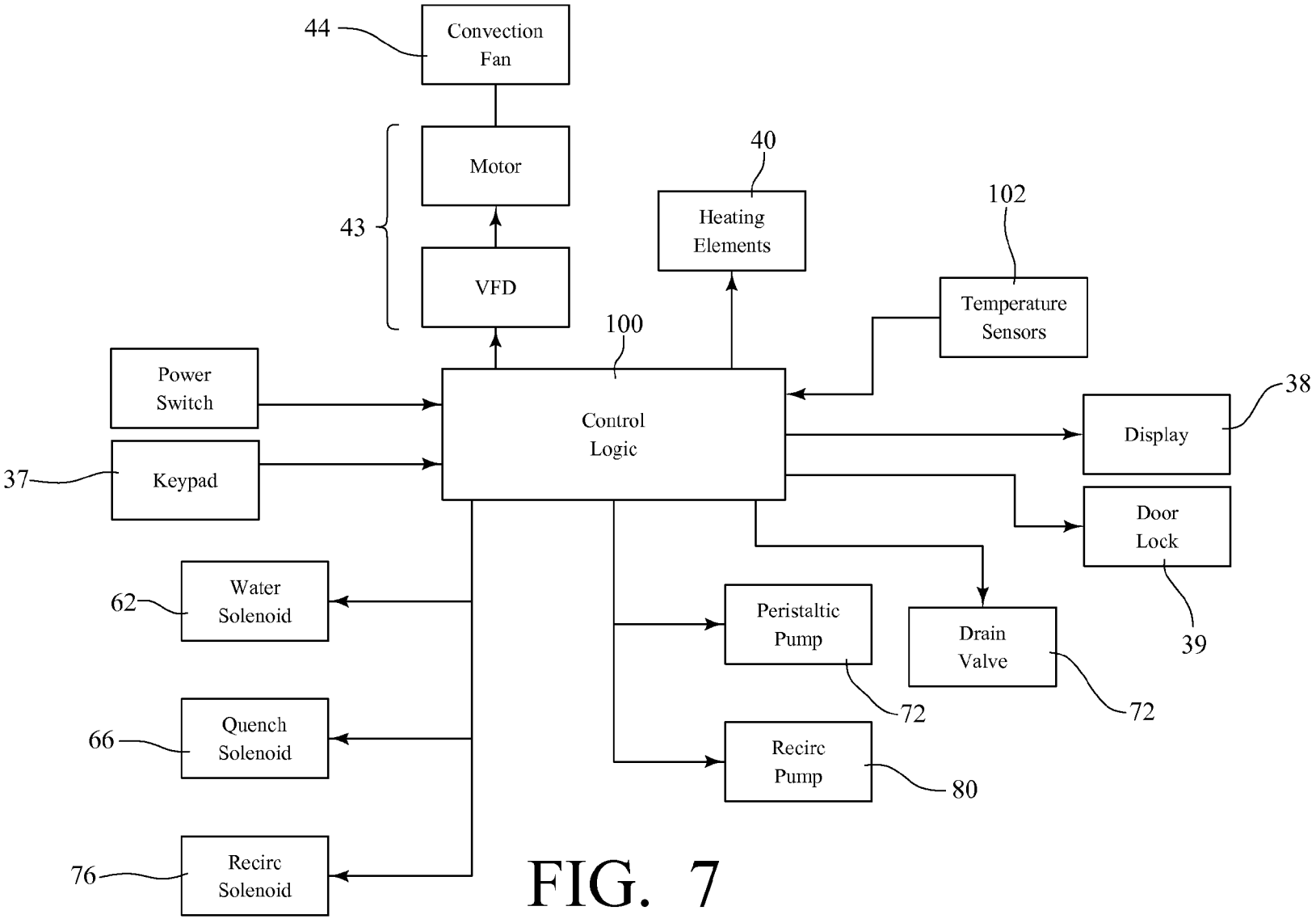
FIG. 7 is a block diagram that illustrates the inputs received by and outputs controlled by the control logic of the exemplary self-cleaning convection oven of FIGS. 1-5.

To further illustrate the operation of the self-cleaning oven of the present invention, FIG. 7 is a block diagram that illustrates the inputs received by and outputs controlled by a control logic 100. It should be recognized and understood that the control logic 100 in this exemplary embodiment is a software code that is resident on electronic circuitry (not shown) within the cabinet 20 of the oven 10. Such software coding is readily accomplished by one of ordinary skill in the art with the benefit of the present disclosure. Furthermore, FIG. 8 is a workflow diagram, illustrating a representative self-cleaning cycle for the exemplary self-cleaning convection oven 10 of FIGS. 1-5, while FIG. 9 is a timing diagram that illustrates the status of certain components of the plumbing system during the representative self-cleaning cycle of FIG. 8.

Figures 1, 8:
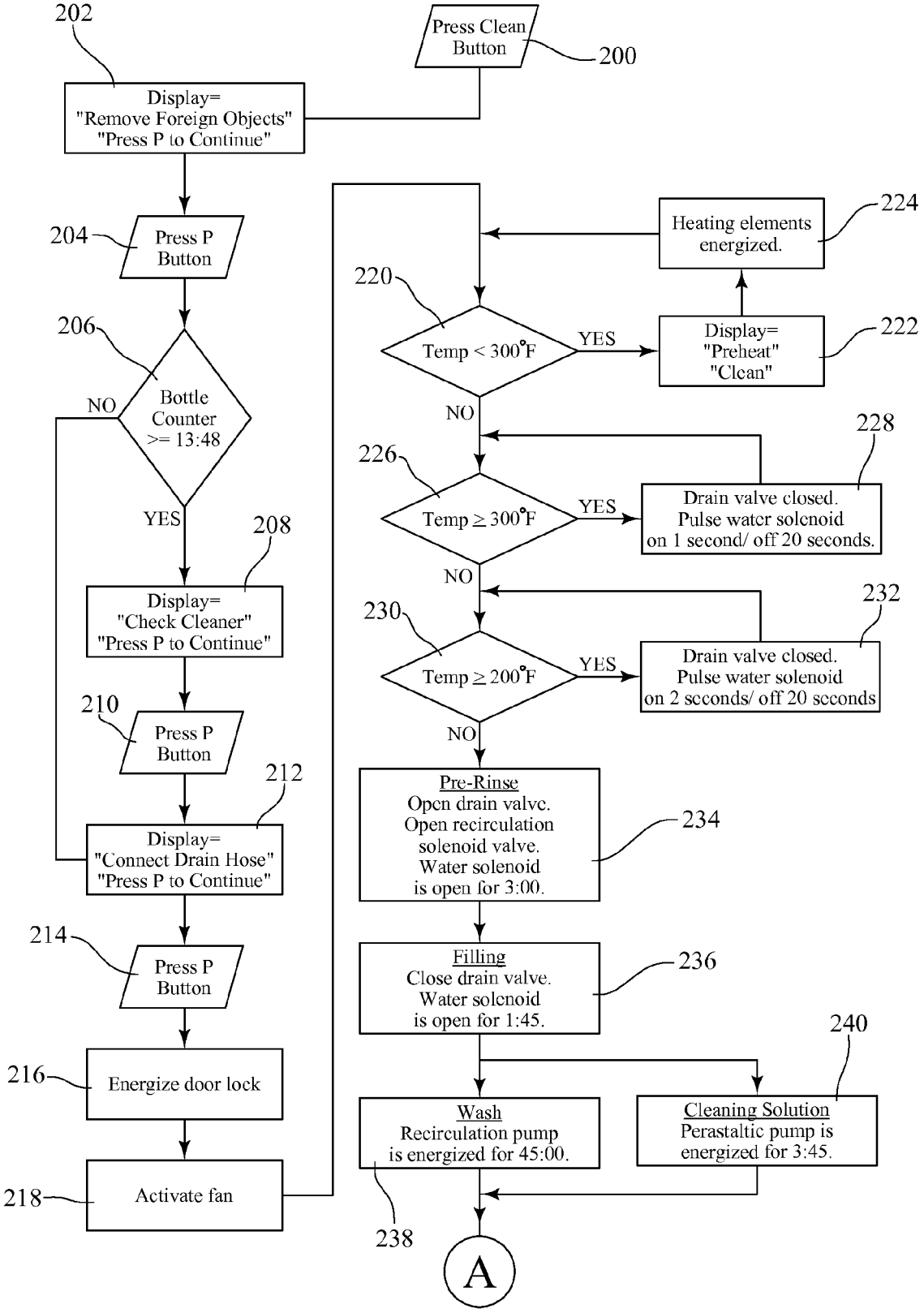
FIG. 8 is a workflow diagram, illustrating a representative self-cleaning cycle for the exemplary self-cleaning convection oven of FIGS. 1-5.
Figures 2, 8:
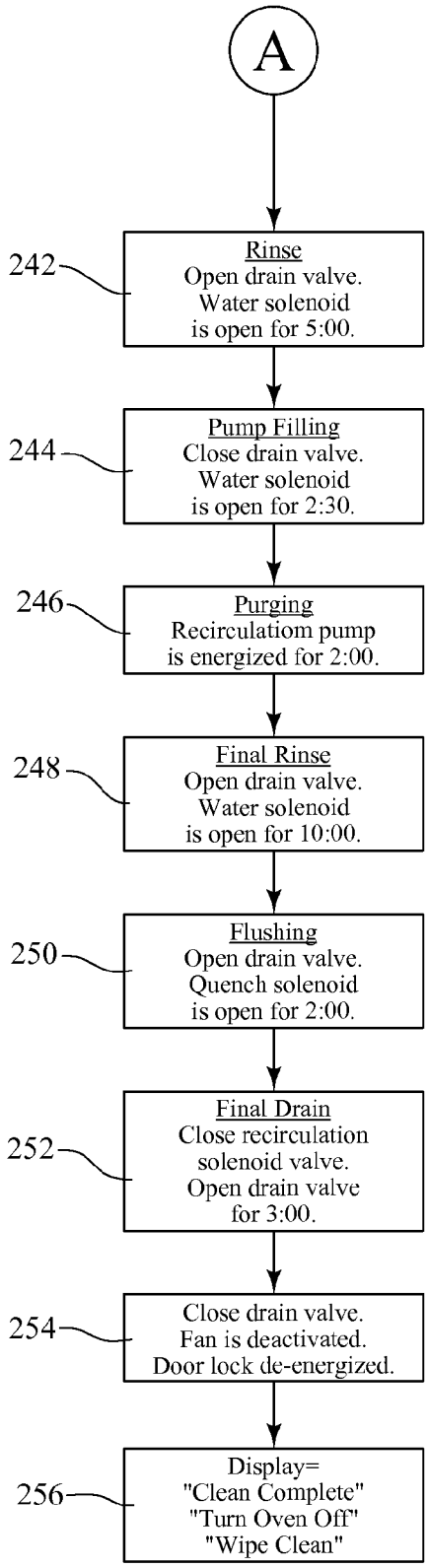
Figure 9:
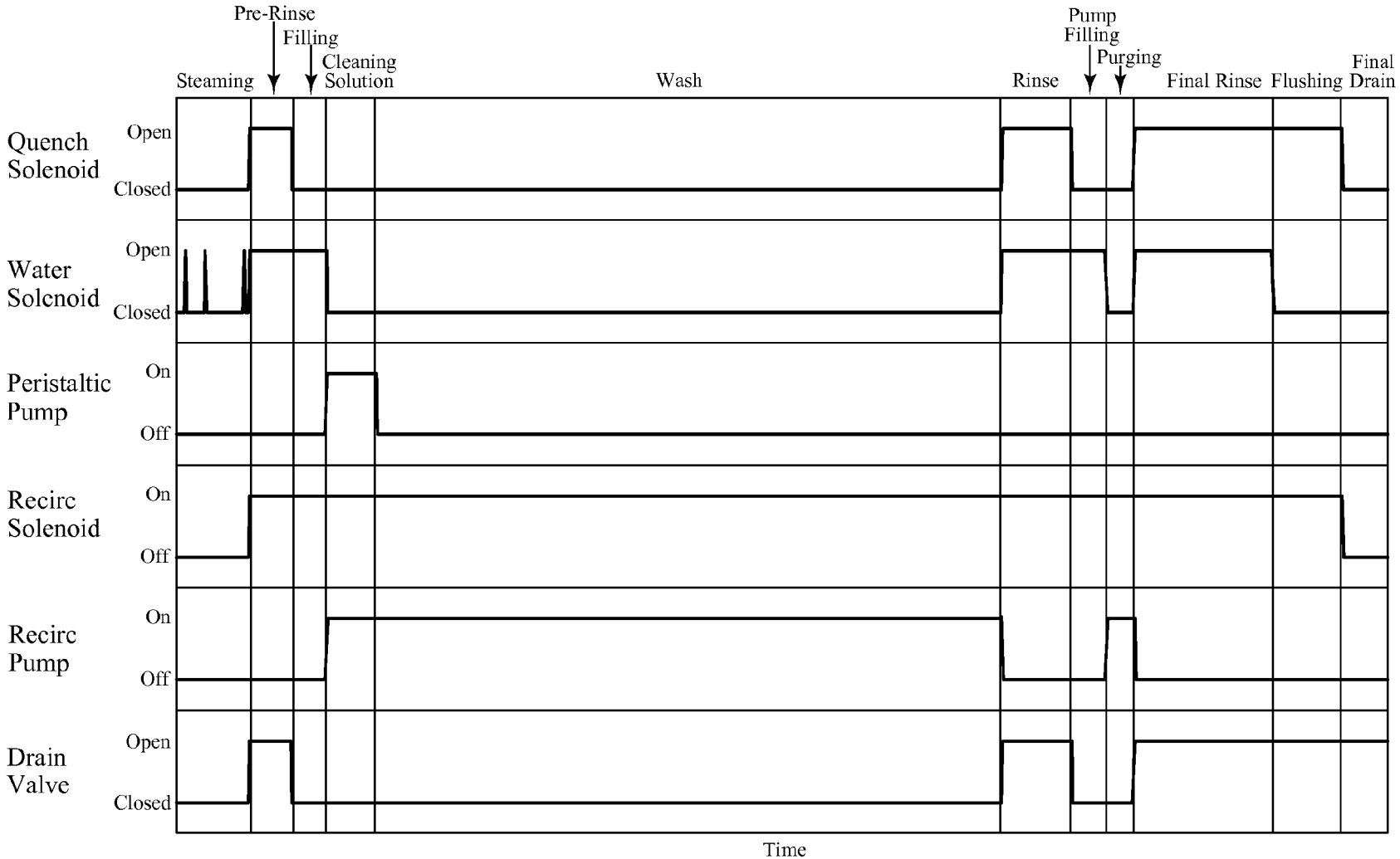
FIG. 9 is a timing diagram that illustrates the status of certain components of the plumbing system during the representative self-cleaning cycle of FIG. 8.

Referring now to FIGS. 8 and 9, in operation, a representative self-cleaning cycle is initiated by pressing a button on a keypad 37 on the front surface of the oven 10 (as shown in FIGS. 1-3), as indicated by input 200 in FIG. 8. Once the self-cleaning cycle has been initiated, a display 38 on the front surface of the oven 10 (as also shown in FIGS. 1-3) then prompts the operator to remove any foreign objects from within the oven 10, as indicated by step 202 in FIG. 8. Once the operator presses the appropriate button on the keypad 37 to confirm that any foreign objects have been removed, as indicated by input 204 in FIG. 8, the control logic 100 makes a determination as to whether the bottle of cleaning solution has been in use for more than a predetermined time period, as indicated by decision 206 in FIG. 8. If so, the display 38 then prompts the operator to check the bottle of cleaning solution, as indicated by step 208 in FIG. 8. The operator then presses the appropriate button on the keypad 37 to confirm that the bottle of cleaning solution is in place and ready, as indicated by input 210 in FIG. 8.

Once it has been confirmed that there is sufficient cleaning solution in the bottle to complete a self-cleaning cycle, the display 38 then prompts the operator to connect one end of a drain hose (not shown) to a drain pipe 34 (as shown in FIGS. 1-4) that extends from the bottom of the oven 10, as indicated by step 212 in FIG. 8. As discussed above, the effluent from the interior cavity 22 of the oven 10 passes from the drain 30 and through a conduit 31 to the recirculation pump 80 when the drain valve 32 is closed. However, when the drain valve 32 is open, the effluent passes out the drain 30, through the drain valve 32, and then through the drain pipe 34, as shown in FIG. 3 and the schematic diagram of FIG. 6. Thus, a drain hose must be connected to the drain pipe 34 to direct the effluent to an appropriate floor drain. For instance, the drain hose may be connected to the drain pipe 34 by employing a quick-connect fitting in order to provide a quick and secure means to connect the drain hose to the drain pipe 34. Of course, any other known means of connecting a drain hose to the drain pipe 34 may be used without departing from the spirit and scope of the present invention.

Referring again to FIGS. 8 and 9, once the operator presses the appropriate button on the keypad 37 to confirm that the drain hose has been connected to the drain pipe 34, as indicated by input 214 in FIG. 8, the self-cleaning cycle commences. In this exemplary embodiment, the control logic 100 first energizes a door lock (not shown) to lock the door 24 in a closed position, as indicated by step 216 in FIG. 8. This prevents the door 24 from being opened during the self-cleaning cycle. As a further refinement, the control logic 100 could also be programmed to keep the door lock energized if an error condition is detected due to a component failure. The door 24 would then remain locked until an appropriate service code was entered via the keypad 37 by a repair technician.

Once the door lock has been energized to commence the self-cleaning cycle, the control logic 100 activates the convection fan 42, which begins to rotate to begin cooling the oven 10 from a normal operating temperature (for example, 450° F.) to an appropriate temperature for cleaning the oven 10, as indicated by step 218 in FIG. 8.

This cooling of the oven 10 may be further accomplished by opening and closing the water solenoid valve 62 such that water is discharged from the first nozzle 64 onto the convection fan 42 and is then distributed throughout the interior cavity 22 of the oven 10. By discharging water onto the convection fan 42 and into the interior cavity 22 of the oven 10 while the oven 10 is at a higher operating temperature, the water is vaporized by the heat that is present in the interior cavity 22 of the oven 10 and effectively cools the oven 10 while also performing a steam cleaning function. In this regard, the steam that is generated during this process can be exhausted through an oven vent (not shown).

Specifically, and referring again to the block diagram of FIG. 7, with respect to cooling the oven 10 and performing an initial steam cleaning function, in this exemplary embodiment, the oven 10 is provided with one or more temperature sensors 102 positioned in the interior cavity 22 of the oven 10 that provide an output signal to the control logic 100 representative of the current temperature within the oven 10. Referring again to FIG. 8, the control logic 100 makes a determination as to whether the temperature is below a first predetermined threshold (for example, 300° F.), as indicated by decision 220 in FIG. 8. If so, the display 38 then informs the operator that the oven 10 is entering a "Preheat" and "Clean" mode, in which the heating elements 40 are energized to raise the temperature to an appropriate level for the steam cleaning function, as indicated by steps 222, 224 in FIG. 8. This may occur if the oven 10 has been off for a time period before the self-cleaning cycle is initiated. In most cases, however, the temperature will be above the first predetermined threshold because the oven 10 will have been recently used. If the control logic 100 determines that the temperature is above the first predetermined threshold, as indicated by decision 226 in FIG. 8, opening and closing of the water solenoid valve 62 commences. In the representative self-cleaning cycle illustrated in FIGS. 8 and 9, the drain valve 32 is closed, and the control logic 100 operates the water solenoid valve 62 to pulse cold water for one second on, twenty seconds off, as indicated by step 228 in FIG. 8. Such pulsing continues until the control logic 100 determines that the temperature has fallen below the predetermined threshold, as also indicated by decision 226 in FIG. 8, at which time a determination is then made as to whether the temperature is below a second predetermined threshold (for example, 200° F.), as indicated by decision 230 in FIG. 8. If not, a second pulsing cycle commences. In the representative self-cleaning cycle illustrated in FIGS. 8 and 9, the drain valve 32 remains closed, and the control logic 100 operates the water solenoid valve 62 to pulse cold water for two seconds on, twenty seconds off, as indicated by step 232 in FIG. 8. This second pulsing cycle continues until the control logic 100 determines that the temperature has fallen below the second predetermined threshold, as also indicated by decision 230 in FIG. 8.

After the oven 10 has reached an appropriate temperature for cleaning the oven 10, the control logic 100 then initiates the pre-rinse phase of the self-cleaning cycle, as indicated by step 234 in FIG. 8. First, the recirculation solenoid valve 76 is opened, and the drain valve 32 is opened. The water solenoid valve 62 is then opened for a predetermined time period (for example, three minutes) to discharge water onto the convection fan 42, such that the water is distributed throughout the interior cavity 22 of the oven 10 and allowed to flow down the drain 30 and out the drain pipe 34. In this pre-rinse phase, it should be also noted that the temperature of the interior cavity 22 of the oven 10 is maintained at a slightly elevated level (for example, 180° F.) by energizing the heating elements 40.

After the pre-rinse phase has been completed, the control logic 100 then initiates the filling phase of the self-cleaning cycle, as indicated by step 236 in FIG. 8. During the filling phase, the drain valve 32 is closed. The water solenoid valve 62 is then opened for a predetermined time period (for example, one minute, forty-five seconds) to allow the interior cavity 22 of the oven 10 to fill with a volume of water. In this regard, the pressure regulator 60 associated with the water supply can be adjusted to a desired level such that water flowing through the water solenoid valve 62 and into the interior cavity 22 of the oven 10 is regulated to allow a desired amount of water to be delivered to the interior cavity 22 of the oven 10 within the predetermined time period.

Once the interior cavity 22 of the oven 10 has been filled with a volume of water, the control logic 100 then initiates the wash phase of the self-cleaning cycle. The recirculation pump 80 is energized for a predetermined time period (for example, forty-five minutes) while the drain valve 32 remains closed, as indicated by step 238 in FIG. 8. The effluent from the interior cavity 22 of the oven 10 is thus pumped through the drain 30 and through the conduit 31 to the recirculation pump 80. The effluent then passes through the recirculation pump 80 and is delivered through a conduit 81 to the cross connector 74. At the same time, the peristaltic pump 72 is also energized for a predetermined time period (for example, three minutes, forty-five seconds), to allow a specified amount of cleaning solution to be delivered through the length of tubing 73 to the cross connector 74, as indicated by step 240 in FIG. 8. From the cross connector 74, which, as discussed above, mixes the chemical solution from the peristaltic pump 72 with the effluent draining from the interior cavity 22 of the oven 10 and passing though the recirculation pump 80, the mixture of cleaning solution and the effluent is delivered to the recirculation solenoid valve 76 by a conduit 75. From the recirculation solenoid valve 76, the mixture of cleaning solution and the effluent is then delivered through the length of tubing 77 to the second nozzle 82. Again, and as best shown in FIG. 3, the mixture of cleaning solution and the effluent is then discharged directly onto the convection fan 42 for distribution throughout the interior cavity 22 of the oven 10. As with the pre-rinse phase, the temperature of the interior cavity 22 of the oven 10 is again maintained at a slightly elevated level (for example, 180° F.) by activating the heating elements 40.

It should also be noted that the recirculation solenoid valve 76 is typically closed during normal cooking operations to prevent hot air from the interior cavity 22 of the oven 10 from circulating through the recirculation pump 80 and other plumbing components. However, during the self-cleaning cycle, the recirculation solenoid valve 76 is open to allow the delivery of the mixture of cleaning solution and the effluent to the interior cavity 22 of the oven 10.

Furthermore, with respect to the delivery of the mixture of cleaning solution and the effluent to the interior cavity 22 of the oven 10, it should also be noted that, during the wash phase, the convection fan 42 continues to operate, but the direction of rotation can be periodically altered by reversing the motor 43 (shown in FIG. 5) at specified time intervals. By reversing the motor 43 (shown in FIG. 5) at specified time intervals, the cleaning solution can be more evenly distributed throughout the interior cavity 22 of the oven 10 by the convection fan 42. Furthermore, reversing the direction of the convection fan 42 at specified intervals during the wash phase also allows for any errors in the self-cleaning cycle to be detected and the self-cleaning cycle to be aborted, if necessary. For example, if the resistance encountered by the convection fan 42 is too high due to an increased amount of water in the interior cavity 22 of the oven 10, the control logic 100 may be programmed to turn off the convection fan 42 and abort the self-cleaning cycle.

Once the wash phase has been completed, the control logic 100 then initiates the rinse phase of the self-cleaning cycle, as indicated by step 242 in FIG. 8. During the rinse phase, the drain valve 32 is opened, and the recirculation pump 80 is de-energized. The water solenoid valve 62 is then opened for a predetermined time period (for example, five minutes) to deliver fresh water through the first nozzle 64 and into the interior cavity 22 of the oven 10. At this point during the self-cleaning cycle, the quench solenoid valve 66 is also open, such that fresh water is also delivered through the quench solenoid valve 66, though the cross connector 74, and then through the second nozzle 82 into the interior cavity 22 of the oven 10. As the fresh water is discharged into the oven 10, the convection fan 42 continues to operate such that the fresh water is distributed throughout the interior cavity 22 of the oven 10 to effectively rinse the surfaces of the interior cavity 22 of the oven 10.

Once the rinse phase has been completed, the control logic 100 then initiates a pump filling phase of the self-cleaning cycle, as indicated by step 244 in FIG. 8. The drain valve 32 is closed, and the quench solenoid valve 66 is closed, while the water solenoid valve 62 remains open to fill the interior cavity 22 of the oven 10 with a predetermined amount of fresh water.

Once this pump filling phase has been completed, the control logic 100 then initiates a purging phase of the self-cleaning cycle, as indicated by step 246 in FIG. 8. The water solenoid valve 62 is closed, and the recirculation pump 80 is energized to circulate the fresh water through the plumbing system, effectively purging the plumbing system of any remaining cleaning solution.

Once the purging phase has been completed, the control logic 100 then initiates a final rinse phase of the self-cleaning cycle, as indicated by step 248 in FIG. 8. The recirculation pump 80 is de-energized, and the drain valve 32 is opened. The water solenoid valve 62 and the quench solenoid valve 66 are again opened for a predetermined time period (for example, ten minutes) to distribute water to the interior cavity 22 of the oven 10 and to distribute water through the recirculation components of the plumbing system.

Once the final rinse phase has been completed, the control logic 100 then initiates a flushing phase of the self-cleaning cycle, as indicated by step 250 in FIG. 8. In the flushing phase, the water solenoid valve 62 is closed, while the quench solenoid valve 66 remains open. This allows water to continue to flow through the recirculation portion of the plumbing system, including the recirculation pump 80, and then down the drain 30.

Once the flushing phase has been completed, the quench solenoid valve 66 and the recirculation solenoid valve 76 are closed, while the drain valve 32 remains open for a predetermined time period (for example, three minutes) to allow any water remaining in the system to drain, as indicated by step 252 in FIG. 8.

At the conclusion of this self-cleaning cycle, the drain valve 32 is closed, as indicated by step 254 in FIG. 8. The convection fan 42, which has been operating during the entire course of the self-cleaning cycle, is also deactivated, and the door lock is de-energized. Finally, the display then informs the operator that "Clean Complete" and prompts the operator to "Turn Oven Off" and "Wipe Clean," as indicated by step 256 in FIG. 8.

As mentioned above, the self-cleaning cycle may be aborted if errors are detected. In this regard, a means for detecting errors during the self-cleaning cycle can be incorporated into the control logic 100 itself or can be incorporated into one or more sensors that detect such an error and then communicate that error to the control logic 100. For example, as a further refinement, it is contemplated that a capacitive proximity sensor 110 (shown in FIG. 4) could be incorporated into the oven 10, such that the amount of water present in the interior cavity 22 of the oven 10 can be detected during the self-cleaning cycle, and any errors with respect to the amount of water present could then be communicated to the control logic 100 so that the cleaning cycle can be aborted, if necessary.

As another refinement, in some exemplary embodiments, a de-liming port 120 (shown in FIG. 4) could be provided to allow the oven 10 to incorporate a de-liming phase into the self-cleaning cycle. Specifically, an additional pump would be provided and connected in-line with the recirculation portion of the plumbing system, such that a de-liming solution could be pumped into the plumbing system and used to remove any lime build-up that results from the cooking of various food products.

As yet another refinement, it is contemplated that the self-cleaning oven of the present invention could be to provide a means to steam cook various food products, such as bread products and the like. As such, in some exemplary embodiments, an orifice 130 (shown in FIG. 3) could be provided into the interior cavity 22 of the oven 10, such that an additional nozzle would be inserted into the interior cavity 22 of the oven 10 and used to provide an appropriate amount of water for steam cooking a food product.

One of ordinary skill in the art will recognize that additional embodiments are possible without departing from the teachings of the present invention or the scope of the claims which follow. This detailed description, and particularly the specific details of the exemplary embodiment disclosed herein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A self-cleaning oven, comprising:

a cabinet defining an interior cavity for cooking a food product;

a door moveable between an open position and a closed position for allowing access to the interior cavity;

one or more heating elements positioned in the interior cavity for delivering heat to the interior cavity;

a fan positioned within the interior cavity near the one or more heating elements for circulating heated air within the interior cavity during normal cooking operations;

a first nozzle positioned in the interior cavity of the oven outside of and above the fan, the first nozzle aimed at a periphery of the fan; and a plumbing system operably connected to a water supply for delivering water into the interior cavity of the oven through the first nozzle, such that, as part of a self-cleaning operation, water is discharged onto the periphery of the fan for distribution throughout the interior cavity of the oven.

2. The self-cleaning oven as recited in claim 1, in which the plumbing system includes a water solenoid valve, such that when the water solenoid valve is open, water is delivered from the water supply to the first nozzle.

3. The self-cleaning oven as recited in claim 1, in which the plumbing system also delivers a cleaning solution into the interior cavity of the oven.

4. The self-cleaning oven as recited in claim 3, in which the cleaning solution is delivered to the interior cavity of the oven through a second nozzle positioned outside of and above the fan.

5. The self-cleaning oven as recited in claim 3, in which the plumbing system includes a pump for drawing the cleaning solution from a storage receptacle.

6. The self-cleaning oven as recited in claim 5, in which the cleaning solution drawn from the storage receptacle is mixed with an effluent draining from the interior cavity of the oven through a drain, thus creating a mixture of the cleaning solution and the effluent that is then delivered into the interior cavity of the oven.

7. The self-cleaning oven as recited in claim 6, in which the mixture of the cleaning solution and the effluent is delivered to the interior cavity of the oven through a second nozzle positioned outside of and above the fan.

8. The self-cleaning oven as recited in claim 7, in which the plumbing system includes a recirculation pump that is positioned between the second nozzle and the drain for circulating the mixture of the cleaning solution and the effluent.

9. The self-cleaning oven as recited in claim 8, in which the plumbing system further includes a recirculation solenoid valve positioned between the recirculation pump and the second nozzle, wherein the recirculation solenoid valve is closed during normal cooking operations to prevent hot air from the interior cavity of the oven from circulating through the plumbing system.

10. The self-cleaning oven as recited in claim 6, in which the plumbing system includes a cross connector for mixing the cleaning solution with the effluent draining from the interior cavity of the oven through the drain.

11. The self-cleaning oven as recited in claim 10, in which the plumbing system includes a water solenoid valve, such that when the water solenoid valve is open, water is delivered from the water supply to the first nozzle.

12. The self-cleaning oven as recited in claim 11, in which the plumbing system further includes a quench solenoid valve, such that, when the quench solenoid valve is open, water is delivered from the water supply to the cross connector.

13. A method for cleaning an oven having a cabinet defining an interior cavity for cooking a food product, a door moveable between an open position and a closed position for allowing access to the interior cavity, one or more heating elements positioned in the interior cavity for delivering heat to the interior cavity, and a fan positioned within the interior cavity for circulating heated air within the interior cavity during normal cooking operations, the method comprising the steps of:

placing the door in the closed position;

activating the fan; and delivering water into the interior cavity of the oven through a first nozzle positioned outside of and above the fan, the first nozzle aimed at a periphery of the fan, such that water is discharged onto the periphery of the fan for distribution throughout the interior cavity of the oven.

14. The method for cleaning an oven as recited in claim 13, and further comprising the step of:

delivering a cleaning solution into the interior cavity of the oven through a second nozzle positioned outside of and above the fan, such that the cleaning solution is distributed throughout the interior cavity of the oven.

15. A method for cleaning an oven having a cabinet defining an interior cavity for cooking a food product, a door moveable between an open position and a closed position for allowing access to the interior cavity, one or more heating elements positioned in the interior cavity for delivering heat to the interior cavity, and a fan positioned within the interior cavity for circulating heated air within the interior cavity during normal cooking operations, the method comprising the steps of:

placing the door in the closed position;

activating the fan;

initiating a pre-rinse phase by opening a drain valve associated with a drain from the interior cavity of the oven, and opening a water solenoid valve for a predetermined time period to discharge water through a first nozzle outside of and above the fan, the first nozzle aimed at a periphery of the fan, such that water is discharged onto the periphery of the fan for distribution throughout the interior cavity of the oven;

initiating a filling phase by closing the drain valve, while the water solenoid valve remains open for a predetermined time period to fill the interior cavity of the oven with a volume of water; and initiating a wash phase by energizing a recirculation pump for a predetermined time period while the drain valve remains closed, which pumps an effluent from the interior cavity that passes through the drain, mixes the effluent with a specified amount of a cleaning solution in a cross connector to create a mixture of the cleaning solution and the effluent, and then delivers the mixture to the interior cavity of the oven through a second nozzle positioned outside of and above the fan.

16. The method for cleaning an oven as recited in claim 15, wherein said oven further includes a quench solenoid valve, such that, when the quench solenoid valve is open, water is delivered from the water supply to the cross connector, and further comprising the steps of:

initiating a rinse phase by opening the drain valve, de-energizing the recirculation pump, and then opening the water solenoid valve and the quench solenoid valve for a predetermined time period to deliver water through the first nozzle and the second nozzle and into the interior cavity of the oven;

initiating a pump filling phase by closing the drain valve and closing the quench solenoid valve, while the water solenoid valve remains open to fill the interior cavity of the oven with a predetermined amount of water;

initiating a purging phase by closing the water solenoid valve and energizing the recirculation pump;

initiating a final rinse phase by de-energizing the recirculation pump, opening the drain valve, and then opening the water solenoid valve and the quench solenoid valve for a predetermined time period; and initiating a flushing phase by closing the water solenoid valve, while the quench solenoid valve remains open, thus allowing water to flow through the recirculation pump and associated tubing.

17. A self-cleaning oven, comprising:

a cabinet defining an interior cavity for cooking a food product;

a door moveable between an open position and a closed position for allowing access to the interior cavity;

one or more heating elements positioned in the interior cavity for delivering heat to the interior cavity;

a fan positioned within the interior cavity near the one or more heating elements for circulating heated air within the interior cavity during normal cooking operations;

a first nozzle positioned in the interior cavity of the oven outside of and above the fan, the first nozzle aimed at a periphery of the fan;

a second nozzle positioned in the interior cavity of the oven outside of and above the fan; and a plumbing system that (i) is operably connected to a water supply for delivering water into the interior cavity of the oven through the first nozzle, such that, as part of a self-cleaning operation, water is discharged onto the periphery of the fan for distribution throughout the interior cavity of the oven, (ii) includes a pump for drawing a cleaning solution from a storage receptacle, and (iii) mixes the cleaning solution drawn from the storage receptacle with an effluent draining from the interior cavity of the oven through a drain, thus creating a mixture of the cleaning solution and the effluent that is then delivered into the interior cavity of the oven through the second nozzle as part of the self-cleaning operation.

18. The self-cleaning oven as recited in claim 17, in which the plumbing system includes a cross connector for mixing the cleaning solution with the effluent draining from the interior cavity of the oven through the drain.

* * * * *